US006971916B2

(12) United States Patent
Tokunaga

(10) Patent No.: US 6,971,916 B2
(45) Date of Patent: Dec. 6, 2005

(54) ELECTRICAL CONNECTOR FOR USE IN TRANSMITTING A SIGNAL

(75) Inventor: Takashi Tokunaga, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 6 days.

(21) Appl. No.: 10/810,699

(22) Filed: Mar. 29, 2004

(65) Prior Publication Data

US 2005/0215120 A1 Sep. 29, 2005

(51) Int. Cl.[7] ..... H01R 13/648

(52) U.S. Cl. ..... 439/608; 409/108

(58) Field of Search ..... 439/608, 108, 439/101, 607, 609, 610

(56) References Cited

U.S. PATENT DOCUMENTS

| | | | | |
|---|---|---|---|---|
| 4,611,867 | A * | 9/1986 | Ichimura et al. | 439/101 |
| 5,201,855 | A * | 4/1993 | Ikola | 439/608 |
| 2004/0201084 | A1 | 10/2004 | Nakada | |

FOREIGN PATENT DOCUMENTS

| | | |
|---|---|---|
| JP | 4934435 | 9/1974 |
| JP | 573881 | 10/1993 |
| JP | 2537698 | 7/1996 |
| JP | 9330770 | 12/1997 |
| JP | 2000113928 | 4/2000 |
| JP | 2002117938 | 4/2002 |

* cited by examiner

*Primary Examiner*—Gary Paumen
(74) *Attorney, Agent, or Firm*—Baker Botts L.L.P.

(57) ABSTRACT

An electrical connector comprises a plurality of conductive contacts arranged in a matrix pattern with a space left from one another and a conductive ground member disposed in the space. The ground member comprises a plurality of first ground plates and a plurality of second ground plates combined with the first ground plates. Each of the first ground plates has a plurality of first slit portions. Each of the second ground plates has a plurality of second slit portions. The contacts are received in one-to-one correspondence in a plurality of contact receiving portions defined by combining the first and the second ground plates in a lattice fashion in the state that the second and the first ground plates are inserted in the first and the second slit portions, respectively. Each of the first slit portions has at least one contacting portion contacted with the second ground plate inserted therein.

8 Claims, 4 Drawing Sheets

ELECTRICAL CONNECTOR FOR USE IN TRANSMITTING A SIGNAL

BACKGROUND OF THE INVENTION

This invention relates to an electrical connector for use in transmitting a signal and, in particular, to an electrical connector for use in transmitting a high-speed signal.

For example, an electrical connector of the type is disclosed in Japanese Patent Application Publication (JP-A) No. 2002-117938 (Reference 1). The electrical connector comprises a plurality of pin contacts, a housing holding the contacts, and a plurality of ground plates.

The ground plates includes first and second ground plates. One of the first and the second ground plates has a first contacting portion connected to at least one of the contacts and a second contacting portion connecting the first and the second ground plates to each other. The first ground plate is placed between adjacent ones of the contacts. The second ground plate extends in a direction intersecting with the first ground plate and is placed between adjacent ones of the contacts.

Another electrical connector disclosed in Japanese Patent Application Publication (JP-A) No. H09-330770 (Reference 2) comprises a plurality of ground terminals and a plurality of signal terminals disposed in a staggered arrangement. Each of the ground terminals has a cross-shaped section. Each of cross protrusions of the ground terminal extend between adjacent ones of the signal terminals. With this structure, each signal terminal is surrounded by four ground terminals around the signal terminal so that a pseudo coaxial line is formed.

In the electric connector disclosed in Reference 1, the ground plates are used to prevent occurrence of crosstalk between the contacts. However, it is difficult to completely surround and shield the contacts.

In the electrical connector disclosed in Reference 2, the pseudo coaxial line is formed so as to completely shield the signal terminal. In order to form such a coaxial structure, however, the electrical connector inevitably has a complicated configuration and requires an increased number of parts.

SUMMARY OF THE INVENTION

It is an object of this invention to provide an electrical connector which is capable of forming a pseudo coaxial line in a simple structure so as to reduce occurrence of crosstalk between contacts and to prevent degradation of transmission characteristics and which requires a reduced number of parts.

According to this invention, there is provided an electrical connector comprising a plurality of conductive contacts arranged in a matrix pattern with a space left from one another, a conductive ground member disposed in the space, and an insulator holding the contacts and the ground member, wherein:

the ground member comprises a plurality of first ground plates and a plurality of second ground plates combined with the first ground plates;

each of the first ground plates having a first side and a first opposite side opposite to the first side and a plurality of first slit portions extending from the first side towards the first opposite side;

each of the second ground plates having a second side and a second opposite side opposite to the second side and a plurality of second slit portions extending from the second side towards the second opposite side;

the contacts being received in one-to-one correspondence in a plurality of contact receiving portions defined by combining the first and the second ground plates in a lattice fashion in the state that the second ground plates are inserted in the first slit portions while the first ground plates are inserted in the second slit portions;

each of the first slit portions having at least one contacting portion contacted with the second ground plate inserted therein.

DESCRIPTION OF THE PREFERRED EMBODIMENTS

Figure 1:
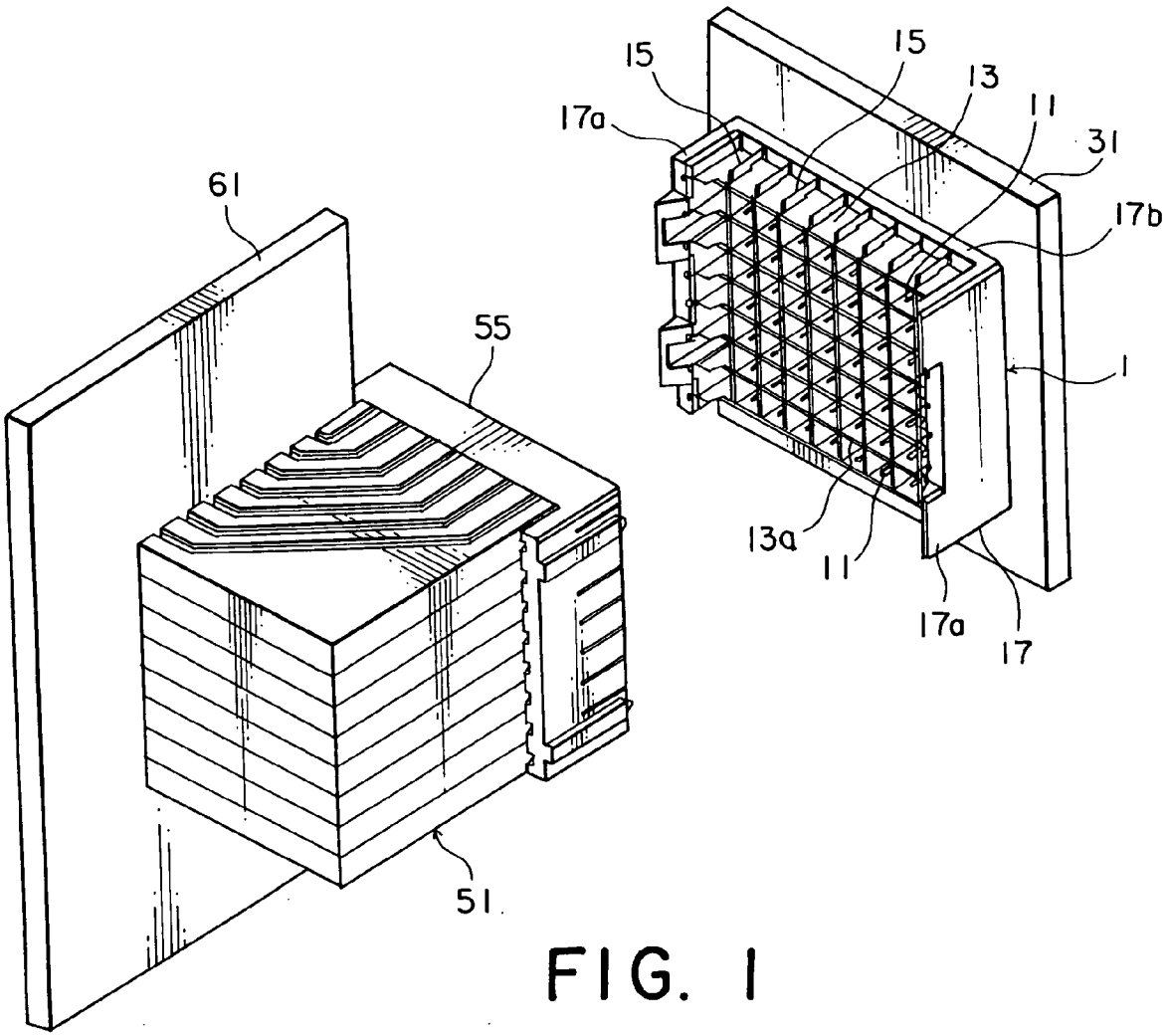
FIG. 1 is a perspective view of a connector according to a first embodiment of this invention, together with a mating connector to be coupled and connected thereto.

Now, description will be made of an electrical connector according to this invention with reference to the drawing.

Figure 2:
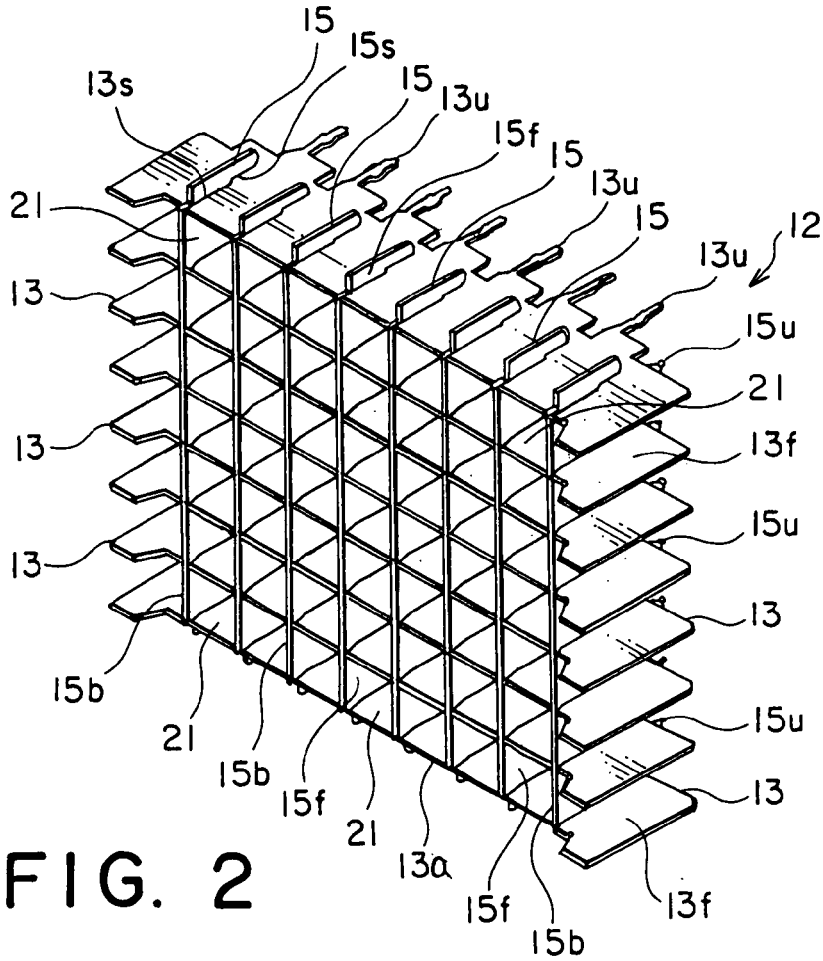
FIG. 2 is a perspective view of an assembly of first and second ground plates of the connector illustrated in FIG. 1.

Referring to FIGS. 1 and 2, a connector 1 according to a first embodiment of this invention comprises a plurality of conductive contacts (signal contacts) 11 arranged in a matrix fashion, i.e., in a vertical direction and in a horizontal direction, with a predetermined space left from one another, a ground member 12 arranged between adjacent ones of the contacts with a preselected space left from each contact, and an insulator 17 holding the contacts 11 and the ground member 12.

Each of the contacts 11 in this embodiment is a pin contact for signal transmission and reception. The ground member 12 comprises a plurality of first ground plates 13 and a plurality of second ground plates 15. Each of the first ground plates 13 is formed as an elongate plate by punching a thin conductive plate using a punch press. Likewise, each of the second ground plate 15 is formed by the similar process as an elongate plate.

In this embodiment, the first ground plates 13, eight in number, are arranged in parallel to one another with the predetermined space left from one another in the vertical direction, as illustrated in FIGS. 1 and 2. Likewise, the second ground plates 15, eight in number, are arranged in parallel to one another with the predetermined space left from one another in the horizontal direction. The first and the second ground plates 13 and 15 are combined and coupled to be perpendicular to each other to form an assembly as the ground member 12.

When the first and the second ground plates 13 and 15 are combined as illustrated in FIGS. 1 and 2, a plurality of contact accommodating portions 21, forty-nine in number, are formed in a lattice fashion to be adjacent to one another in the vertical and the horizontal directions. The contact accommodating portions 21 are shielded from one another by the first and the second ground plates 13 and 15. Each of the contact accommodating portions 21 has a generally rectangular shape if the connector 1 in FIG. 1 is seen from a front side.

Each of the contact accommodating portions 21 extends from the front side of the connector 1 towards a rear side as an elongate cylinder. In each contact accommodating portions 21, each single contact 11 is disposed.

Figure 3:
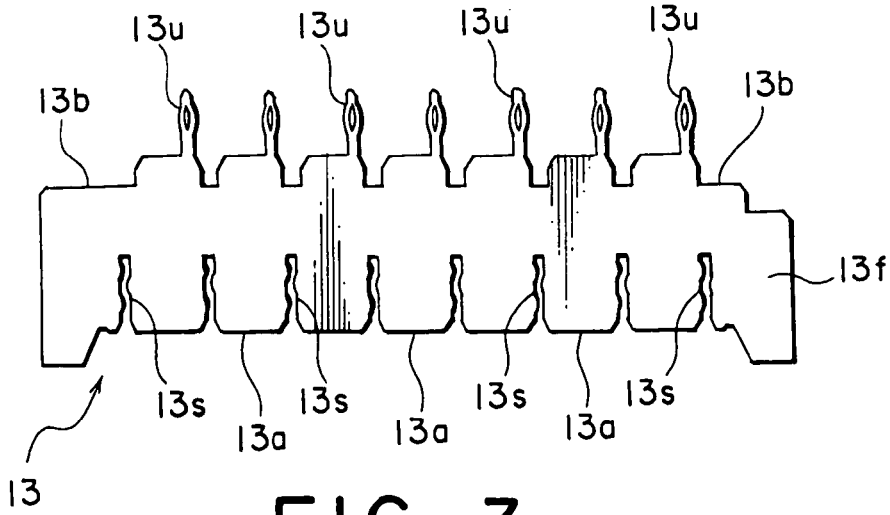
FIG. 3 is an enlarged plan view of the first ground plate illustrated in FIGS. 1 and 2.

Referring to FIG. 3, each of the first ground plates 13 illustrated in FIGS. 1 and 2 has opposite surfaces as first plate surfaces 13*f* (only one being illustrated in the figure) and a first side 13*a* as one side parallel to a longitudinal direction of the first ground plate 13 and a first opposite side 13*b* as the other side opposite to the first side 13*a*.

The first ground plate 13 is provided with a plurality of first slit portions 13*s* each of which is formed as a groove cut between the first plate surfaces 13*f*. Each of the first slit portions 13*s* extends from the first side 13*a* towards the first opposite side 13*b* of the first ground plate 13. The first slit portions 13 are arranged at predetermined intervals in the longitudinal direction of the first ground plate 13.

On the first opposite side 13*b*, a plurality of first ground terminal portions 13*u* are formed and extend from the first opposite side 13*b* outward of the first plate surfaces 13*f*.

Figure 4:
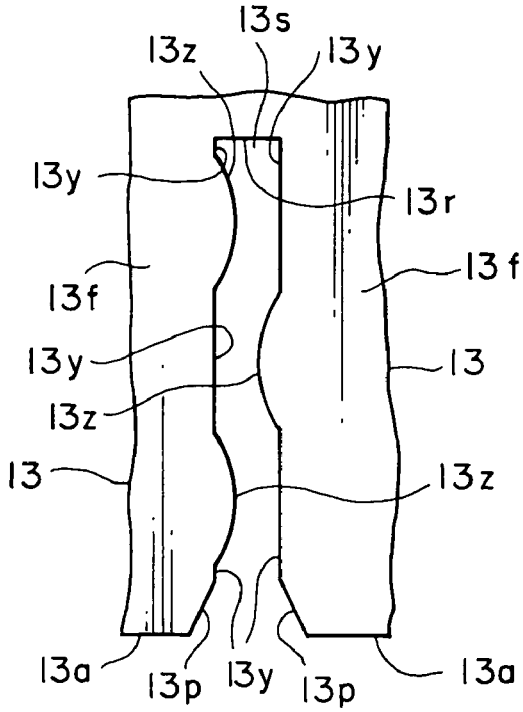
FIG. 4 is an enlarged plan view of a first slit portion of the first ground plate illustrated in FIG. 3.

Referring to FIG. 4, each of the first slit portions 13*s* will be described in detail.

The first slit portion 13*s* has a pair of first slit edges 13*y* linearly extending in a direction perpendicular to the first side 13*a* and a plurality of first contacting portions 13*z* arcuately protruding from the first slit edges 13*y* inward of the first slit portion 13*s*.

The first slit edges 13*y* are faced to each other in a direction parallel to the first side 13*a* (i.e., in the longitudinal direction of the first ground plate 13) and are spaced from each other to leave a predetermined gap. The gap between the first slit edges 13*y* is substantially equal to the thickness of the second ground plate 15. The first contacting portions 13*z* are formed alternately on the first slit edges 13*y*.

The first slit portion 13*s* has a pair of first slant edges 13*p* formed on the first slit edges 13*y* at portions adjacent to the first side 13*a* so that the first slit 13*s* is widened from the first slit edges 13*y* towards the first side 13*a*. When the first and the second ground plates 13 and 15 are combined with each other, the first contacting portions 13*z* are brought into contact with second plate surfaces 15*f* of the second ground plate 15.

Figure 5:
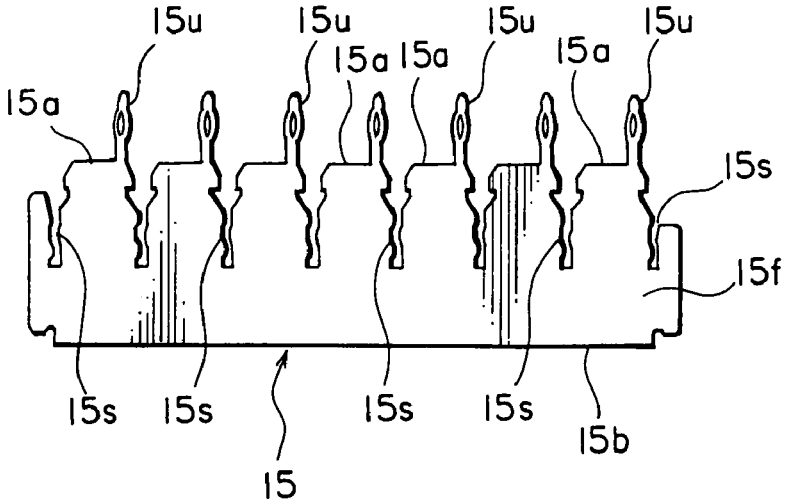
FIG. 5 is an enlarged plan view of the second ground plate illustrated in FIGS. 1 and 2.

Referring to FIG. 5, each of the second ground plates 15 illustrated in FIGS. 1 and 2 has opposite surfaces as the second plate surfaces 15*f* (only one being illustrated in the figure) and a second side 15*a* as one side parallel to a longitudinal direction of the second ground plate 15 and a second opposite side 15*b* as the other side opposite to the second side 15*a*. The second ground plate 15 is provided with a plurality of second slit portions 15*s* each of which is formed as a groove cut between the second plate surfaces 15*f*. Each of the second slit portions 15*s* extends from the second side 15*a* towards the second opposite side 15*b* of the second ground plate 13. The second slit portions 15 are arranged at predetermined intervals in the longitudinal direction of the second ground plate 15.

On the second opposite side 15*b*, a plurality of second ground terminal portions 15*u* are formed and extend from the second opposite side 15*b* outward of the second plate surfaces 15*f*.

Figure 6:
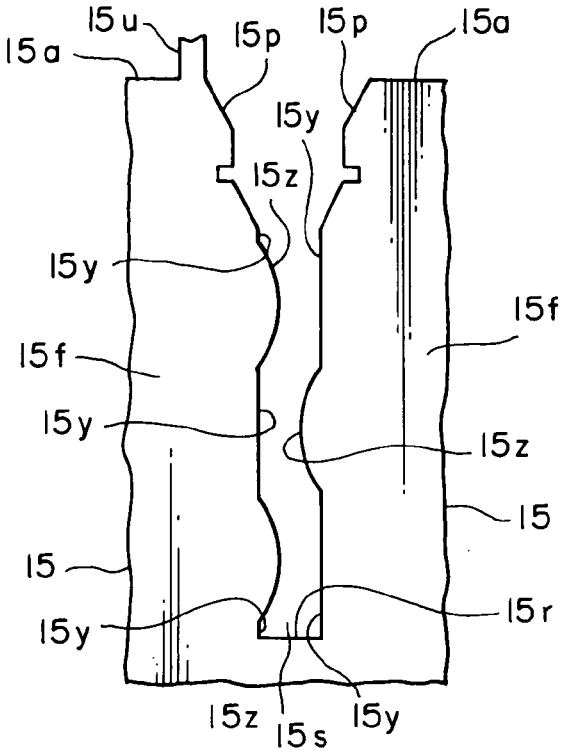
FIG. 6 is an enlarged plan view of a second slit portion of the second ground plate illustrated in FIG. 5.

Referring to FIG. 6, each of the second slit portions 15*s* will be described in detail.

The second slit portion 15*s* has a pair of second slit edges 15*y* linearly extending in a direction perpendicular to the second side 15*a* and a plurality of second contacting portions 15*z* arcuately protruding from the second slit edges 15*y* inward of the second slit portion 15*s*.

The second slit edges 15*y* are faced to each other in a direction parallel to the second side 15*a* (i.e., in the longitudinal direction of the second ground plate 15) and are spaced from each other to leave a predetermined gap. The gap between the second slit edges 15*y* is substantially equal to the thickness of the first ground plate 13. The second contacting portions 15*z* are formed alternately on the second slit edges 15*y*.

The second slit portion 15*s* has a pair of second slant edges 15*p* formed on the second slit edges 15*y* at portions adjacent to the second side 15*a* so that the second slit 15*s* is widened from the second slit edges 15*y* towards the second side 15*a*.

When the first and the second ground plates 13 and 15 are combined with each other, the second contacting portions 15*z* are brought into contact with the first plate surfaces 13*f* of the first ground plate 13.

Turning back to FIG. 1, the insulator 17 has a pair of frame portions 17*a* faced to each other and a base plate portion 17*b* connecting the frame portions 17*a*. The frame portions 17*a* extends from two parallel sides of the base plate portion 17*b* above one surface of the base plate portion 17*b*. When the connector 1 is mounted to a substrate 31, such as a printed circuit board, the other surface of the base plate portion 17*b* is faced to the substrate 31.

Hereinafter, description will be made of an operation of manufacturing the connector 1 in this embodiment and mounting the connector 1 to the substrate 31.

Referring to FIG. 1, the contacts 11 are held on the base plate portion 17*b* of the insulator 17 with the predetermined space left from one another in the vertical and the horizontal directions. The first ground plates 13 arranged parallel to one another are positioned to be perpendicular to the second ground plates 15 arranged parallel to one another in the manner such that the first slits 13*s* are faced to the second slits 15*s*. The first and the second ground plates 13 and 15 are press-fitted to each other in directions intersecting with each other by engaging the first and the second slits 13*s* and 15*s* to obtain the assembly in which the first and the second ground plates 13 and 15 are combined in the lattice fashion.

When the first and the second slits 13*s* and 15*s* are combined with each other, the first and the second ground plates 13 and 15 are easily guided into the second and the first slits 15*s* and 13*s*, respectively, by the first slant edges 13*p* formed on the first slit 13*s* at the portions adjacent to the first side 13*a* and the second slant edges 15*p* formed on the second slit 15*s* at the portions adjacent to the second side 15*a*.

When the first and the second ground plates 13 and 15 are combined with each other, the first contacting portions 13*z* are brought into press contact with the second plate surfaces 15*f*. On the other hand, the second contacting portions 15*z* are brought into press contact with the first plate surfaces 13*f*.

Thereafter, the assembly is held on the insulator 17. The insulator 17 is mounted to the substrate 31 and terminal portions (not shown) of the contacts 11 are connected to a signal circuit of the substrate 31. At this time, the first ground terminal portions 13*u* illustrated in FIG. 2 are connected to a ground circuit (not shown) formed on the substrate 31 (FIG. 1) on which the connector 1 is mounted. The second ground terminal portions 15*u* are connected to the ground circuit formed on the substrate 31 (FIG. 1) on which the connector 1 is mounted. Thus, the electrical connector is given a structure with a pseudo coaxial line.

The first and the second slit portions 13*s* and 15*s* may be designed so that bottom surfaces 13*r* and 15*f* of the first and the second slit portions 13*s* and 15*s* are butted to each other when the first and the second ground plates 13 and 15 are combined. In this event, when the connector 1 is mounted to the substrate 31, the first and the second ground terminal portions 13*u* and 15*u* can be press-fitted to through holes (not shown) of the substrate 31 by simply pressing the second ground plates 15 against the substrate 31.

Continuously referring to FIG. 1, a mating connector 51 to be coupled and connected to the connector 1 comprises a plurality of mating contacts (not shown), a mating insulator 55 holding the mating contacts, and a mating ground member (not shown) to be contacted with the ground member 12 comprising the first and the second ground plates 13 and 15. The mating connector 51 is mounted to a mating substrate 61, such as a printed circuit board.

The contacts 11 are individually placed in the contact accommodating portions 21, respectively. Therefore, by the first and the second ground plates 13 and 15 contacted with each other through the first and the second contacting portions 13*z* and 15*z*, the contacts 11 are completely shielded from one another. With this structure, it is possible to prevent occurrence of crosstalk between the contacts 11 and deterioration in transmission characteristics.

Figure 7:
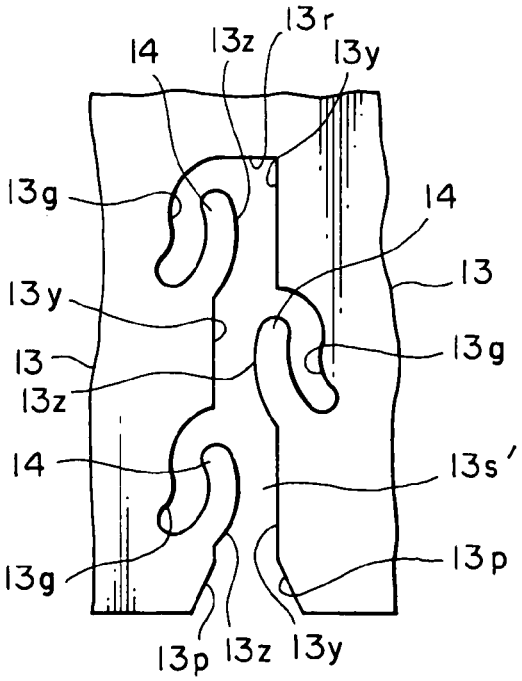
FIG. 7 is an enlarged plan view of a first slit portion of a first ground plate of a connector according to a second embodiment of this invention.

Referring to FIG. 7, a connector according to a second embodiment is similar to the connector in the first embodiment except that the first ground plate 13 has a first slit portion 13*s*' different in structure from the first slit portion 13*s*. Similar parts are designated by like reference numerals and description thereof will be omitted.

As illustrated in FIG. 7, the first slit edges 13*y* of the first slit portion 13*s*' are provided with a plurality of first additional slit portions 13*g* each of which is formed as a cut groove connected to the first slit 13*s*'. The first additional slit portions 13*g* extend from the first slit edges 13*y* along the first contacting portions 13*z* inward of the first contacting portions 13*z*.

Thus, the first contacting portions 13*z* in this embodiment form first contacting portions 14 of an arm-like curved shape by the presence of the first additional slit portions 13*g*. When the first and the second ground plates 13 and 15 are combined with each other, the first contacting portions 14 are brought into elastic contact with the second plate surfaces 15*f* of the second ground plate 15.

In the second embodiment, the first additional slit portions 13*g* are formed in the first ground plate 13 to form the first contacting portions 14. Alternatively or additionally, the second ground plate 15 may be provided with a plurality of additional slit portions similar to the first additional slit portions to form second contacting portions similar in shape to the first contacting portions 14.

In the first and the second embodiments, description has been directed to the case where the first and the second ground plates 13 and 15 have the first and the second contacting portions 13*z* and 15*z*, respectively. Alternatively, only one of the first and the second ground plates 13 and 15 may be provided with the contacting portions.

In the foregoing embodiments, a plurality of the first and the second contacting portions 13*z* and 15*z* are formed. Alternatively, each of the first and the second contacting portions 13*z* and 15*z* may be formed at only one position of each of the first and the second slit edges 13*y* and 15*y*.

The gap between the first slit edges 13*y* and the gap between the second slit edges 15*y* may be slightly greater than the thickness of the second ground plate 15 and the thickness of the first ground plate 13, respectively.

The first and the second ground plates 13 and 15 may be chamfered on a coupling side to be coupled to the mating connector 51. In this event, the connector 1 is easily coupled to the mating connector 51.

As described above, in the above-mentioned electrical connector, the first and the second ground plates having the first and the second slit portions are combined into a lattice-like assembly in which the first and the second ground plates are contacted with each other. Therefore, the contacts are completely shielded from one another.

The contacting portions are contacted with at least one plate surface of the first and the second ground plates. Therefore, it is possible to reduce occurrence of crosstalk between the contacts and to avoid deterioration in transmission characteristics.

Since the first and the second plate surfaces are contacted through the contacting portions, the first and the second ground plates exhibits a stable shielding effect.

In addition, the first and the second ground plates have a simple structure which can be formed by punching using a punch press without requiring a bending process. Thus, production is easy and the number of parts is reduced.

The assembly of the first and the second ground plates can easily be assembled if the gap between the first slit edges and the gap between the second slit edges are greater than the thickness of the second ground plate and the thickness of the first ground plate, respectively.

After the assembly is formed, the first or the second plate surface is pressed and contacted by the contacting portions so that no play or wobbling occurs.

If the additional slit portions are formed so that the contacting portions have elasticity, the contacting portions are brought into elastic contact with the first or the second plate surfaces so that a stable contacting condition is achieved. This prevents the first and the second ground plates as thin metal plates from being deformed.

When the connector is mounted to the substrate after the first and the second ground plates are combined with each other, the ground terminal portions can be press-fitted into the through holes formed in the substrate by merely pressing the first or the second ground plates. Therefore, a press-fit tool can be simplified.

Although the present invention has been shown and described in conjunction with a few preferred embodiments thereof, it should be understood by those skilled in the art that the present invention is not limited to the foregoing description but may be changed and modified in various other manners without departing from the spirit and scope of the present invention as set forth in the appended claims.

What is claimed is:

1. An electrical connector comprising a plurality of conductive contacts arranged in a matrix pattern with a space left from one another, a conductive ground member disposed in the space, and an insulator holding the contacts and the ground member, wherein:

the ground member comprises a plurality of first ground plates and a plurality of second ground plates combined with the first ground plates;

each of the first ground plates having a first side and a first opposite side opposite to the first side and a plurality of first slit portions extending from the first side towards the first opposite side;

each of the second ground plates having a second side and a second opposite side opposite to the second side and a plurality of second slit portions extending from the second side towards the second opposite side;

the contacts being received in one-to-one correspondence in a plurality of contact receiving portions defined by combining the first and the second ground plates in a lattice fashion in the state that the second ground plates are inserted in the first slit portions while the first ground plates are inserted in the second slit portions;

each of the first slit portions having at least one contacting portion contacted with the second ground plate inserted therein; wherein each of the first slit portions has a pair of edges faced to each other in a direction perpendicular to the first side, the contacting portion protruding from at least one of the edges and wherein the first ground plate is provided with an additional slit portion formed in the vicinity of the contacting portion so that the contacting portion is brought into elastic contact with the second ground plate.

2. The electrical connector according to claim 1, wherein the edges have straight-line portions parallel to each other, the contacting portion protruding from the straight-line portion in an arcuate shape.

3. The electrical connector according to claim 1, wherein each of the first and the second ground plates is formed as an elongate plate by punching a conductive plate by a punch press, the first and the second ground plates having ground terminal portions extending from the first and the second opposite sides outward of the first and the second ground plates, respectively.

4. The electrical connector according to claim 1, wherein each of the second slit portions has at least one contacting portion contacted with the first ground plate.

5. The electrical connector according to claim 4, wherein each of the second slit portions has a pair of edges faced to each other in a direction perpendicular to the second side, the contacting portion protruding from at least one of the edges.

6. The electrical connector according to claim 5, wherein the second ground plate is provided with an additional slit portion formed in the vicinity of the contacting portion so that the contacting portion is brought into elastic contact with the first ground plate.

7. The electrical connector according to claim 5, wherein the edges have straight-line portions parallel to each other, the contacting portion protruding from the straight-line portion in an arcuate shape.

8. An electrical connector comprising a plurality of conductive contacts arranged in a matrix pattern with a space left from one another, a conductive ground member disposed in the space, and an insulator holding the contacts and the ground member, wherein:

the ground member comprises a plurality of first ground plates and a plurality of second ground plates combined with the first ground plates;

each of the first ground plates having a first side and a first opposite side opposite to the first side and a plurality of first slit portions extending from the first side towards the first opposite side;

each of the second ground plates having a second side and a second opposite side opposite to the second side and a plurality of second slit portions extending from the second side towards the second opposite side;

the contacts being received in one-to-one correspondence in a plurality of contact receiving portions defined by combining the first and the second ground plates in a lattice fashion in the state that the second ground plates are inserted in the first slit portions while the first ground plates are inserted in the second slit portions;

each of the first slit portions having at least one contacting portion contacted with the second ground plate inserted therein; wherein each of the second slit portions has at least one contacting portion contacted with the first ground plate; wherein each of the second slit portions has a pair of edges faced to each other in a direction perpendicular to the second side, the contacting portion protruding from at least one of the edges; and wherein the second ground plate is provided with an additional slit portion formed in the vicinity of the contacting portion so that the contacting portion is brought into elastic contact with the first ground plate.

* * * * *